US006979071B2

(12) United States Patent
Suzuki et al.

(10) Patent No.: US 6,979,071 B2
(45) Date of Patent: Dec. 27, 2005

(54) IMAGE RECORDING APPARATUS

(75) Inventors: Keiichiro Suzuki, Hachioji (JP); Masaru Nagai, Iruma (JP); Takashi Tsutsumi, Hachioji (JP)

(73) Assignee: Konica Minolta Holdings, Inc., (JP)

( * ) Notice: Subject to any disclaimer, the term of this patent is extended or adjusted under 35 U.S.C. 154(b) by 0 days.

(21) Appl. No.: 11/040,508

(22) Filed: Jan. 21, 2005

(65) Prior Publication Data

US 2005/0168521 A1 Aug. 4, 2005

(30) Foreign Application Priority Data

Jan. 29, 2004 (JP) ..... 2004-021769

(51) Int. Cl.[7] ..... B41J 2/165
(52) U.S. Cl. ..... 347/22; 347/28
(58) Field of Search ..... 347/22, 24, 28, 347/33, 104; 198/495–499; 400/635; 271/7, 271/275; 15/256.5, 256.51, 256.52; 399/312, 399/344, 347; 101/425

(56) References Cited

U.S. PATENT DOCUMENTS 4,210,918 A * 7/1980 Hoffmann et al. ..... 347/90
6,106,090 A * 8/2000 Uchida et al. ..... 347/8
6,511,155 B1 * 1/2003 Fassler et al. ..... 347/35
6,916,081 B2 * 7/2005 Nakashima ..... 347/32

FOREIGN PATENT DOCUMENTS

JP 402225231 A * 9/1990 ..... 271/7
JP 2003-205658 7/2003

OTHER PUBLICATIONS

English Abstract for Japanese Patent Application No. 2003-205658 dated Jul. 22, 2003.

* cited by examiner

*Primary Examiner*—Shih-Wen Hsieh
(74) *Attorney, Agent, or Firm*—Cantor Colburn LLP

(57) ABSTRACT

An image recording apparatus for recording an image on a recording medium includes a conveying belt for supporting and conveying the recording medium, and a recording head for recording the image by jetting ink onto the recording medium. The apparatus further includes a plurality of cleaning rollers for cleaning the conveying belt, the cleaning rollers being in pressure-contact with the conveying belt, and a plurality of cleaning liquid baths for respectively storing cleaning liquid to be used to remove dirt deposited on the respective cleaning rollers and for dipping the respective cleaning rollers into the cleaning liquid. The apparatus uses liquid waste as cleaning liquid in a cleaning liquid bath on an upstream side of the conveying belt, the liquid waste having become unable to be used in a cleaning liquid bath on a downstream side of the conveying belt any longer as cleaning liquid.

3 Claims, 3 Drawing Sheets

IMAGE RECORDING APPARATUS

FIELD OF THE INVENTION

The present invention relates to an image recording apparatus, and particularly relates to an image recording apparatus that records an image while conveying a recording medium in a state where the recording medium is in tight contact with a conveying belt.

BACKGROUND OF THE INVENTION

In recent years, the wave of digitization is rapidly coming into the field of image recording. Particularly, the textile printing industry is paying more attention to inkjet type image recording apparatuses suitable for quick response and high-mix low-volume textile printing than to known screen textile printing methods. Likewise, also, the hope of the sign display industry is placed on inkjet type image recording apparatuses that can form images more simply at a lower cost than known screen printing or graver printing.

In the textile printing industry, cloths with low rigidity are main recording media, and in the sign display industry, a woven plastic material (vinyl chloride) is utilized as well as paper or the like. In a case where such a material with low rigidity is employed as a recording medium, the recording medium is usually conveyed by an endless belt to an image recording section including recording heads and others. In such an image recording apparatus, image recording by jetting ink from the recording heads has such a problem that the ink having been jetted from the recording heads may adhere to the conveying belt and the deposited ink stains the recording medium. Therefore, it is necessary to clean the conveying belt.

As an image recording apparatus that performs cleaning of a conveying belt, there is known an image recording apparatus having a cleaning roller formed by a sponge and arranged to be rotatable and contactable with a conveying belt in a state where a lower part of the cleaning roller is dipped in a cleaning liquid in a cleaning liquid bath. The conveying belt is moved in contact with the cleaning roller, and thus the cleaning roller removes dirt of ink deposited on the conveying belt and the like (for example, see Patent Document 1).

In such an image recording apparatus, ink removed from a conveying belt by a cleaning roller gets dissolved into cleaning liquid in a cleaning liquid bath, and ink density of the cleaning liquid in the cleaning bath gradually increases. When the ink density in the liquid bath becomes high, not only the cleaning effect gets lost, but also the conveying belt is contaminated rather more, resulting in staining a recording medium. Therefore, the cleaning liquid is replaced by new cleaning liquid, as necessary. In a known image recording apparatus, usually, when accumulated total moving length of a conveying belt in contact with a cleaning roller, or accumulated total time during which the conveying belt moves in contact with the cleaning roller, comes to a predetermined value, cleaning liquid is automatically replaced.

[Patent Document 1] TOKKAI No. 2003-205658

However, in the case of such a known image recording apparatus, cleaning liquid is equally replaced every time cleaning has been performed with cleaning liquid for a predetermined length or time. Therefore, in order to clean off dirt on a cleaning roller well in any case, the cleaning liquid must be frequently replaced, causing a problem of disposing cleaning liquid as liquid waste more than necessary.

SUMMARY OF THE INVENTION

With this background, an object of the invention is to provide an image recording apparatus which can efficiently clean a conveying belt well enough, attain satisfactory images, and reduce the cost of treating liquid waste.

To solve problems, as described above, in a first aspect of the invention, an image recording apparatus for recording an image on a recording medium includes a conveying belt for supporting and conveying the recording medium, a recording head for recording the image by jetting ink onto the recording medium conveyed by the conveying belt, a plurality of cleaning rollers for cleaning the conveying belt, the cleaning rollers being provided along a conveying direction of the conveying belt and in pressure-contact with the conveying belt, and a plurality of cleaning liquid baths, provided under the respective cleaning rollers, for respectively storing cleaning liquid to be used to remove dirt deposited on the respective cleaning rollers, and for dipping the respective cleaning rollers into the cleaning liquid, wherein the apparatus uses liquid waste as cleaning liquid in a cleaning liquid bath on an upstream side of the conveying belt, the liquid waste having become unable to be used in a cleaning liquid bath on a downstream side of the conveying belt any longer as cleaning liquid.

According to the first aspect, liquid waste having become unable to be used as cleaning liquid in the cleaning liquid bath on the downstream side any longer is used in the cleaning liquid bath on the upstream side as cleaning liquid, and thus the cleaning liquid is used efficiently, reducing the cost of treating liquid waste. While the cleaning roller on the upstream side, herein, roughly removes dirt on the conveying belt, the cleaning roller on the downstream side completely cleans a portion of the conveying belt having been roughly removed of dirt by the cleaning roller on the upstream side. Therefore, the ink density of the cleaning liquid in the cleaning liquid bath on the upstream side may be higher than the ink density of the cleaning liquid in the cleaning liquid bath on the downstream side, wherein the conveying belt can be cleaned well even if the liquid waste on the downstream side is transferred and used as the cleaning liquid on the upstream side.

In a second aspect of the invention, the image recording apparatus of the first aspect includes a liquid supply bath for storing the cleaning liquid and supplying the cleaning liquid at least to a cleaning liquid bath on a most downstream side, a supply pump for supplying the cleaning liquid from the liquid supply bath to the cleaning liquid bath on the downstream side, and a transfer pump for transferring the cleaning liquid from the cleaning liquid bath on the downstream side to the cleaning liquid bath on the upstream side.

According to the second aspect, liquid waste having become unable to be used as cleaning liquid in the cleaning liquid bath on the downstream side is transferred to the cleaning liquid bath on the upstream side by the transfer pump, and then used as cleaning liquid in the cleaning liquid bath on the upstream side, and new cleaning liquid is supplied into the cleaning liquid bath on the downstream side by the supply pump. Thus, cleaning liquid is efficiently used and the cleaning roller on the downstream side is cleaned well by the new cleaning liquid in the cleaning liquid bath. Therefore, dirt remaining on the conveying belt without being removed by the cleaning roller on the upstream side is completely removed by the cleaning roller on the downstream side.

PREFERRED EMBODIMENT OF THE INVENTION

Figure 1:
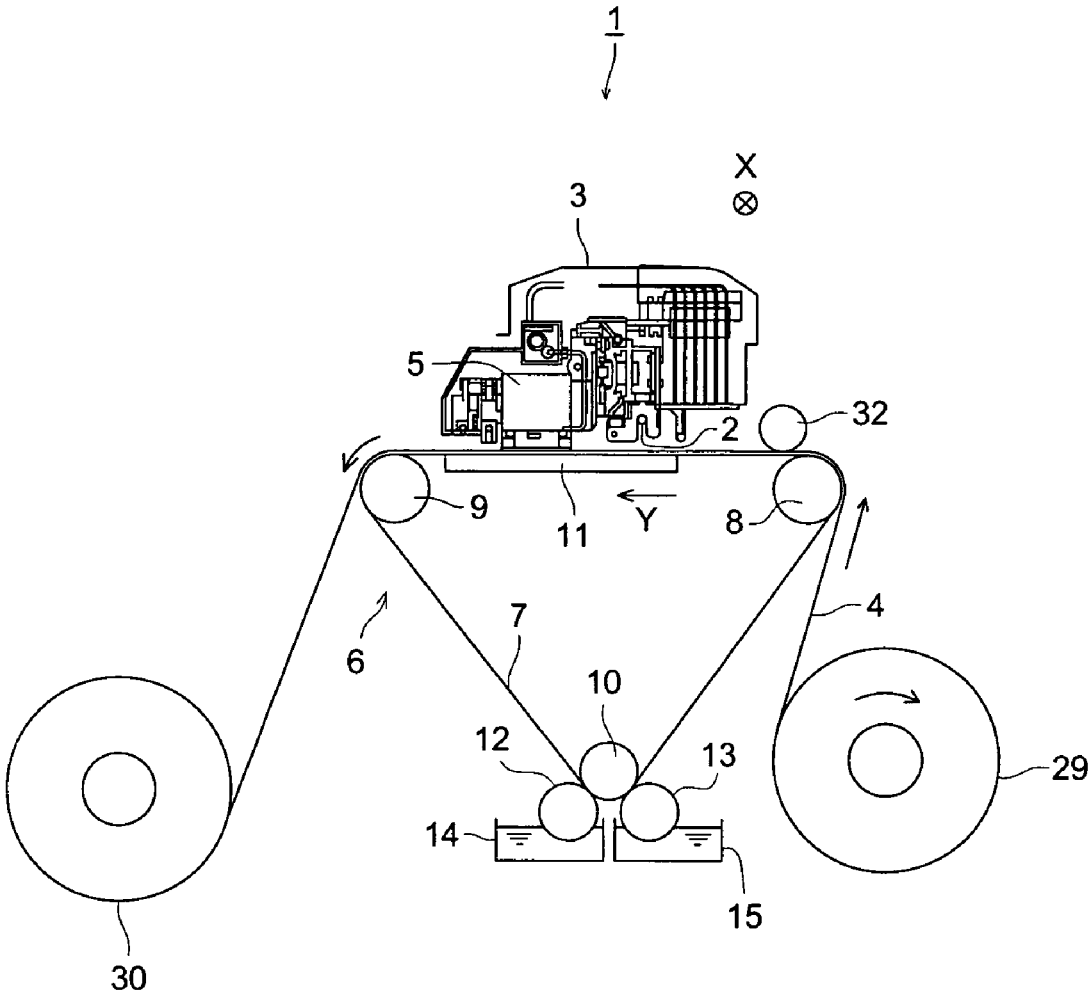
FIG. 1 is a diagram showing a structure of an image recording apparatus in an embodiment of the invention.

The invention includes the following structures.

(1) An image recording apparatus in accordance with the invention includes a conveying belt for supporting and conveying a recording medium and a recording head for jetting ink onto the recording medium, and jets ink onto the recording medium to record an image, the recording medium having been conveyed by the conveying belt, wherein a plurality of cleaning rollers for cleaning the conveying belt is arranged to be contactable with the conveying belt, and a plurality of cleaning liquid baths for respectively storing cleaning liquid for cleaning off dirt deposited on the respective cleaning rollers and for dipping the cleaning rollers in the respective cleaning liquid is provided in order to use liquid waste as cleaning liquid in a cleaning liquid bath on an upstream side, although the liquid waste has been used as cleaning liquid in a cleaning liquid bath on a downstream side and has become unable to be used there any longer as cleaning liquid.

According to above item (1), liquid waste having become unable to be used as cleaning liquid in the cleaning liquid bath on the downstream side any longer is used in the cleaning liquid bath on the upstream side as cleaning liquid, and thus the cleaning liquid is used efficiently, reducing the cost of treating liquid waste. While the cleaning roller on the upstream side, herein, roughly removes dirt on the conveying belt, the cleaning roller on the downstream side completely cleans a portion of the conveying belt having been roughly removed of dirt by the cleaning roller on the upstream side. Therefore, the ink density of the cleaning liquid in the cleaning liquid bath on the upstream side may be higher than the ink density of the cleaning liquid in the cleaning liquid bath on the downstream side, wherein the conveying belt can be cleaned well even if the liquid waste on the downstream side is transferred and used as the cleaning liquid on the upstream side.

(2) The image recording apparatus of item (1) includes a liquid supply bath for storing cleaning liquid and supplying the cleaning liquid at least to a cleaning liquid bath on the most downstream side, wherein a supply pump for supplying the cleaning liquid from the liquid supply bath to the cleaning liquid bath and a transfer pump for transferring the cleaning liquid from the cleaning liquid bath on the downstream side to a cleaning liquid bath on the upstream side are provided.

According to item (2), liquid waste having become unable to be used as cleaning liquid in the cleaning liquid bath on the downstream side is transferred to the cleaning liquid bath on the upstream side by the transfer pump, and then used as cleaning liquid in the cleaning liquid bath on the upstream side, and new cleaning liquid is supplied into the cleaning liquid bath on the downstream side by the supply pump. Thus, cleaning liquid is efficiently used and the cleaning roller on the downstream side is cleaned well by the new cleaning liquid in the cleaning liquid bath. Therefore, dirt remaining on the conveying belt without being removed by the cleaning roller on the upstream side is completely removed by the cleaning roller on the downstream side. Thus, the conveying belt is efficiently cleaned well enough, a satisfactory image is attained, and the cost of treating liquid waste is reduced.

(3) The image recording apparatus of item (2) is provided with a single motor for driving the supply pump and the transfer pump.

According to item (3), since the single motor drives both the supply pump and the transfer pump, miniaturization of the apparatus and cost reduction can be attained.

A preferred embodiment of the invention will be described below referring to FIGS. 1 to 3.

FIG. 1 shows an image recording apparatus 1 in an embodiment of the invention, wherein the image recording apparatus 1 is an image recording apparatus of an inkjet type with serial heads.

The image recording apparatus 1 includes, as shown in FIG. 1, a guide rail 2 in a bar shape, the guide rail 2 supporting a carriage 3. The carriage 3 reciprocally moves along the guide rail 2 in a main scan direction X driven by a carriage driving mechanism (see FIG. 3).

On the carriage 3, there are mounted recording heads 5 provided with nozzles (not shown) for jetting ink in the respective colors of yellow (Y), magenta (M), cyan (C), and black (K) onto a recording medium 4.

Various recording media can be employed as the recording medium 4, and particularly, cloths of various types are preferably used.

The central portion, of the image recording apparatus 1, in which the carriage 3 can move is arranged as a recording area where recording on the recording medium 4 is performed. Through this recording area, there is provided a conveying device 6 for conveying the recording medium 4 in the conveyance direction Y orthogonal to the lateral direction of the recording medium 4. For this conveying device 6, an endless conveying belt 7 is arranged, the belt 7 horizontally conveying the recording medium 4 while supporting it in a flat form. The conveying belt 7 is tensioned by a driving roller 8 for rotating the conveying belt 7, by a first tension roller 9 for horizontally guiding the conveying belt 7 and applying tension to the conveying belt 7, the first tension roller 9 being driven and rotated by the driving roller 8, and by a second tension roller 10 for guiding the conveying belt 7 downward and applying tension to the conveying belt 7. In image recording, the conveying device 6 intermittedly conveys the recording medium 4, repeating conveying and stopping of the recording medium 4 in synchronization with the motion of the carriage 3.

Under the recording medium supporting surface, of the conveying belt 7, that supports the recording medium 4 in a flat form, there is provided an electrostatic force generator 11 for providing the conveying belt 7 with an electrostatic absorbing force to absorb the recording medium 4. The electrostatic force generator 11 includes a pair of electrodes (not shown) in which a cathode and an anode are alternately disposed in a form like comb blades. A direct voltage is applied to this pair of electrodes to electrically charge the conveying belt 7 so that the conveying belt 7 electrostatically absorbs the recording medium 4.

On both sides under the second tension roller 10, an upstream side cleaning roller 12 and a downstream side cleaning roller 13 formed by a sponge for cleaning the conveying belt 7 are respectively arranged, in contact with the conveying belt 7, to be driven to rotate in the same direction as the conveyance direction of the conveying belt 7.

Under the cleaning rollers 12 and 13, an upstream side cleaning liquid bath 14 and a downstream side liquid bath 15 respectively storing water being cleaning liquid are disposed, having the respective lower portions of the cleaning rollers 12 and 13 dipped in the cleaning liquid. Below the downstream side cleaning liquid bath 15, as shown in FIG. 2, there is provided a supply liquid bath 16 for storing cleaning liquid and supplying it to the downstream side cleaning liquid bath 15.

Under the outer bottom surface of the upstream side cleaning liquid bath 14, there are provided an open/close unit 17 (See FIG. 3) such as an open/close valve, and a drain pipe 18 capable of draining out the cleaning liquid in the upstream side cleaning liquid bath 14 as liquid waste. Under the upstream side cleaning liquid bath 14, there is provided a liquid waste bath 19 for storing the liquid waste drained out by the drain pipe 18.

Under the upstream side cleaning liquid bath 14 and the downstream side cleaning liquid bath 15, a cleaning liquid supply unit 20 for supplying the cleaning liquid baths 14, 15 with cleaning liquid is arranged. The cleaning liquid supply unit 20 includes a supply pump 21 for supplying cleaning liquid from the supply liquid bath 16 to the downstream side cleaning liquid bath 15, and a transfer pump for transferring cleaning liquid from the downstream side cleaning liquid bath 15 to the upstream side cleaning liquid bath 14. The supply pump 21 and the transfer pump 22 are tube pumps which suck and discharge liquid in such a manner that each of rotors 23*a*, 23*b* is rotated, and thus a roller 24 arranged on each of the rotors 23*a*, 23*b* makes a rotation motion, while compressing an elastic tube 25. The cleaning liquid supply unit 20 includes a motor 26, which is connected to two transmission gears 27 for transmitting the rotation force of the motor 26. The supply rotor 23*a* being an element of the supply pump 21 and the transferring rotor 23*b* being an element of the transfer pump 22 are connected with the respective transmission gears 27, wherein the rotation forces are transmitted to the rotors 23*a*, 23*b* from the respective transmission gears 27 via respective one-way clutches (not shown).

Figure 2:
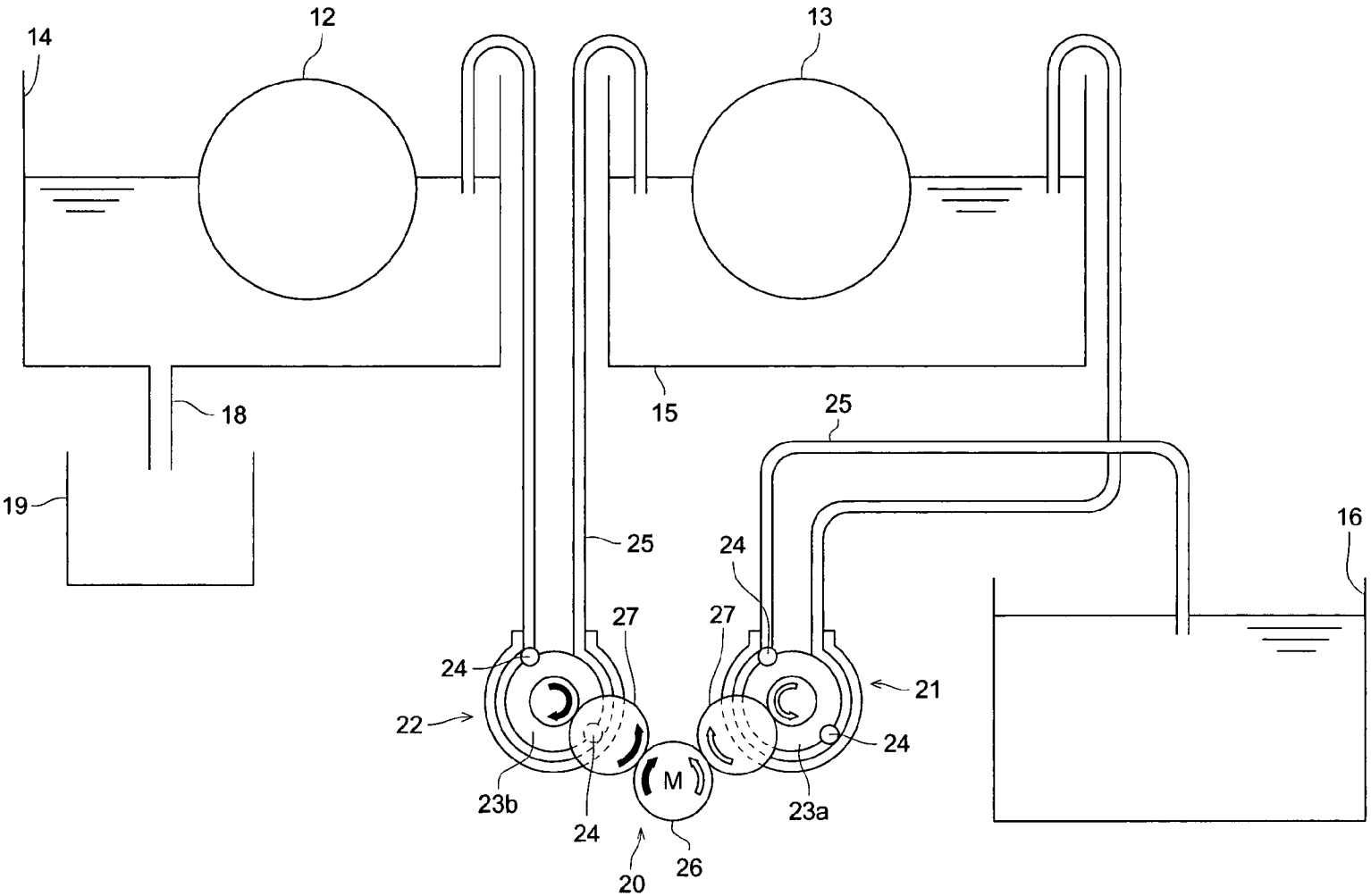
FIG. 2 is a diagram showing a structure of a cleaning liquid supply unit as a part of an image recording apparatus of the invention.

In the present embodiment, when the motor 26 rotates counterclockwise in FIG. 2, the respective transmission gears 27 rotate clockwise, then the rotation force of the transmission gear 27 connected with the supply rotor 23*a* is transmitted to the supply rotor 23*a*, and thus cleaning liquid is supplied from the supply liquid bath 16 to the downstream side cleaning liquid bath 15, while the rotation force of the transmission gear 27 connected with the transferring rotor 23*b* is not transmitted to the transferring rotor 23*b* due to the one-way clutch, and thus cleaning liquid is not transferred from the downstream side cleaning liquid bath 15 to the upstream side cleaning liquid bath 14. In reverse, when the motor 26 rotates clockwise in FIG. 2, the respective transmission gears 27 rotate counterclockwise, then the rotation force of the transmission gear 27 connected with the transferring rotor 23*b* is transmitted to the transferring rotor 23*b*, and thus cleaning water is transferred from the downstream side cleaning liquid bath 15 to the upstream side cleaning liquid bath 14, while the rotation force of the transmission gear 27 connected with the supply rotor 23*a* is not transmitted to the supply rotor 23*a* due to the one-way clutch, and thus cleaning liquid is not supplied from the supply liquid bath 16 to the downstream side cleaning liquid bath 15.

Further, each of the cleaning liquid baths 14, 15 is provided, for example, with a light emitting device, a light receiving device, and a liquid level sensor 28 (see FIG. 3) for detecting a liquid level by the value of the index of refraction of a light beam emitted by the light emitting device.

The image recording apparatus 1 includes, as shown in FIG. 1, a feeding roller 29 for feeding the recording medium 4 in a long size to the feeding device 6 and a winding roller 30 for winding the recording medium 4 with a recorded image. The feeding roller 29 and the winding roller 30 respectively performs feeding operation and winding operation of the recording medium 4 by a roller driving mechanism 31 (see FIG. 3) in synchronization with image recording operation.

Between the feeding roller 29 and the winding roller 30, on the upstream side of the surface of the conveying belt 7, the surface being in contact with the recording medium, a conveying roller 32 for conveying the recording medium 4 together with the conveying belt 7 in the conveyance direction Y is provided.

On the top of the housing of the image recording apparatus 1, there is arranged an input operation section 33 (see FIG. 3) which is constructed as, for example, a touch panel or the like from which a user inputs a user selected type of the recording medium 4.

Figure 3:
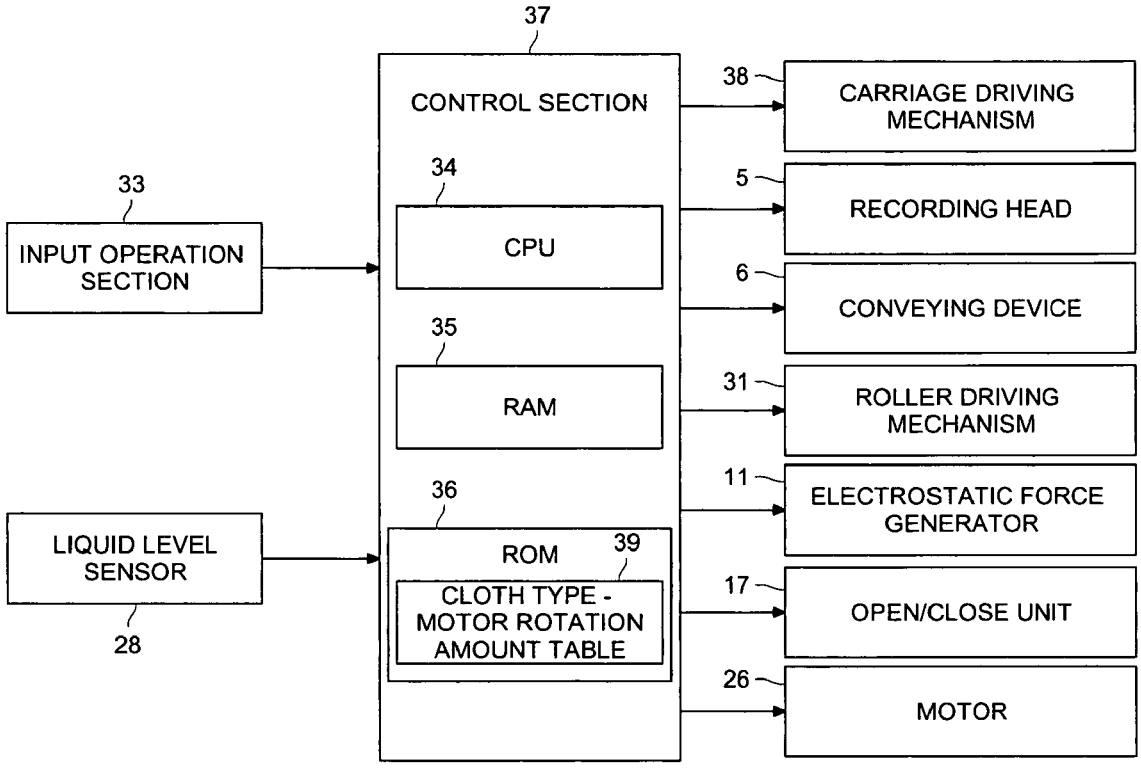
FIG. 3 is a block diagram showing a structure of an image recording apparatus in an embodiment of the invention.

FIG. 3 shows the configuration of a controller for controlling the image recording apparatus 1 of the present embodiment. The controller includes, for example, a CPU 34, a RAM 35, and a ROM 36, and has a control section 37 for expanding a processing program, recorded in the ROM 36, into the RAM 35 and executing the processing program by the CPU 34.

According to the above processing program, the control section 37 controls the operations of respective members, based on status such as the operation status of the carriage driving mechanism 38, the recording heads 5, the conveying device 6, the roller driving mechanism 31, the electrostatic force generator 11, the open/close unit 17, the motor 26, and the like.

Particularly, in the image recording apparatus 1, the control section 37 is connected with the input operation section 33. The control section 37 changes the supply amount of cleaning liquid, controlling the cleaning liquid supply unit 20, corresponding to the type of the recording medium 4, the type having been input from the input operation section 33.

Specifically, the ROM 36 stores a table 39 of cloth type vs. motor rotation amount. In the table 39, the rotation amount of the motor 26 being an element of the cleaning liquid supply unit 20 is set corresponding to the type of cloth, which is the recording medium 4. The table 39 of cloth type vs. motor rotation amount is prepared by obtaining, in advance, respective amounts of cleaning liquid required for completely cleaning off ink deposited on the conveying belt 7 with the downstream side cleaning roller 13, the ink having moved through the recording medium 4 from the printing surface to the backside surface, and then calculating the rotation amounts, of the motor 26, required for supplying the respective obtained amounts of cleaning liquid to the downstream side cleaning liquid bath 15.

When a type of the recording medium 4 is input from the input operation section 33, the control section 37 selects the motor rotation mount corresponding to the recording medium 4, based on the cloth type vs. motor rotation amount table 39, and then, in accordance with the selected motor rotation amount, the control section 37 drives the motor 26 counterclockwise in normal direction in FIG. 2 so that the predetermined amount of cleaning liquid is supplied.

Further, the control section 37 is connected with the liquid level sensor 28, and when the liquid level sensor 28 provided in the downstream side cleaning liquid bath 15 detects that the cleaning liquid level in the downstream side cleaning liquid bath 15 is equal to or higher than a predetermined level, the control section 37 drives the motor 26 clockwise in reverse direction in FIG. 2 in order to stop supplying cleaning liquid from the supply liquid bath 16 to the downstream side cleaning direction liquid bath 15 and transfer cleaning liquid from the downstream side cleaning liquid bath 15 to the upstream side cleaning liquid bath 14. When the liquid level sensor 28 detects that the cleaning liquid level in the downstream side cleaning water 15 is equal to or lower than the predetermined level, the control section 37 drives the motor 26 again in normal direction in order to stop transferring of cleaning liquid from the downstream side cleaning liquid bath 15 to the upstream side cleaning liquid bath 14 and supply cleaning liquid from the supply liquid bath 16 to the downstream side cleaning liquid bath 15.

Still further, when the liquid level sensor 28 provided in the upstream side cleaning liquid bath 14 detects that the cleaning liquid level in the upstream side cleaning liquid bath 14 is equal to or higher than a predetermined level, the control section 37 controls the open/close unit 17 so that cleaning liquid in the upstream side cleaning liquid bath 14 is drained from the drain pipe 18. When the liquid level sensor 28 detects that the cleaning liquid level in the upstream side cleaning liquid bath 14 is equal to or lower than a predetermined level, the control section 37 controls the open/close unit 17 to stop draining of cleaning liquid from the drain pipe 18.

Next, operation in the present embodiment will be described below.

In performing image recording, when a type of the recording medium 4 is input from the input operation section 33 by the user, the control section 37 selects a motor rotation amount corresponding to the recording medium 4, based on the cloth type vs. motor rotation amount table 39, then the motor 26 is driven in the normal direction according to the selected motor rotation amount so that a predetermined amount of cleaning liquid is supplied to the downstream side cleaning liquid bath 15.

On the other hand, the conveying device 6 and the roller driving mechanism 31 run, and thus the recording medium 4 is conveyed toward under the recording heads 5. When the recording medium 4 reaches a predetermined position under the recording heads 5, the carriage driving mechanism 38 operates, thereby the carriage 3 reciprocally moves above the recording medium 4, while ink droplets are sequentially jetted by the recording heads 5 based on image information and land on the recording medium 4 to be cured, and thus image is recorded.

The ink having been jetted by the recording heads 5 and landed on the recording medium 4 moves through it to its backside surface and adheres to the conveying belt 7. A portion, of the conveying belt 7, on which ink is deposited is conveyed by the conveying device 6 to the contact position with the upstream side cleaning roller 12, and when the above portion of the conveying belt 7 passes the upstream side cleaning roller 12, the cleaning roller 12 roughly removes dirt of the ink and the like. The above portion of the conveying belt 7 is further conveyed by the conveying device 6 to the contact position with the downstream side cleaning roller 13, and when the portion of the conveying belt 7 passes the downstream side cleaning roller 13, the cleaning roller 13 completely removes dirt. The upstream side cleaning roller 12 and the downstream side cleaning roller 13, both having absorbed dirt including ink, are respectively rotated; thus the rollers 12, 13 are dipped in cleaning liquid in the respective cleaning liquid baths 14, 15; dirt including ink absorbed from the conveying belt 7 is cleaned off from the rollers 12, 13; and the rollers 12, 13 respectively come in contact with the conveying belt again in a clean state to remove dirt deposited on the conveying belt 7.

An amount of ink having moved through the recording medium to its backside surface, the amount corresponding to the type of the recording medium 4, is removed by the cleaning rollers 12, 13, and the ink deposited on the cleaning rollers 12, 13 is dissolved into the cleaning liquid in the cleaning liquid baths 14, 15. In the downstream side cleaning liquid bath 15, cleaning liquid of the amount corresponding to the type of the recording medium 4 is supplied from the supply liquid bath 16, and therefore, cleaning liquid in the downstream side cleaning liquid bath 15 is diluted by newly supplied cleaning liquid, which reduces rise in the ink concentration of cleaning liquid.

Further, when cleaning liquid is supplied to the downstream side cleaning liquid bath 15 and the liquid level sensor 28 detects that the liquid level in the downstream side cleaning liquid bath 15 is equal to or higher than a predetermined level, the control section 37 controls the motor 26 to rotate in reverse direction so that supply of cleaning liquid from the supply liquid bath 16 to the downstream side cleaning liquid bath 15 is stopped and cleaning liquid is transferred from the downstream side cleaning liquid bath 15 to the upstream side cleaning liquid bath 14. The upstream side cleaning roller 12 roughly removes ink deposited on the conveying belt 7 prior to the downstream side cleaning roller 13, and then the downstream side cleaning roller 13 completely removes the remaining ink. Thus, the ink concentration in the downstream side cleaning liquid bath 15 is kept lower than the ink concentration in the upstream side cleaning liquid bath 14. Therefore, transfer of cleaning liquid in the downstream side cleaning liquid bath 15 to the upstream side cleaning liquid bath 14 dilutes cleaning liquid in the upstream side cleaning liquid bath 14, reducing rise in ink concentration of the cleaning liquid.

When the liquid level sensor 28 detects that the cleaning liquid level in the downstream side cleaning liquid bath 15 is equal to or lower than the predetermined level, the control section 37 again rotates the motor 26 in normal direction to stop transfer of cleaning liquid from the downstream side cleaning liquid bath 15 to the upstream side cleaning liquid bath 14 and to supply cleaning liquid from the supply liquid bath 16 to the downstream side cleaning bath 15.

Further, when cleaning liquid is transferred from the downstream side cleaning liquid bath 15 to the upstream side cleaning liquid bath 14, and then the liquid level sensor 28 detects that the liquid level in the upstream side cleaning liquid bath 14 is equal to or higher than the predetermined level, the control section 37 controls the open/close unit 17 to drain cleaning liquid in the upstream side cleaning liquid bath 14 from the drain pipe 18. When the liquid level sensor 28 detects that the liquid level in the upstream side cleaning liquid bath 14 is equal to or lower than the predetermined level, the control section 37 controls the open/close unit 17 to stop draining of cleaning liquid from the drain pipe 18.

In such a manner, by repeating rotation of the motor 26 in normal direction and reverse direction, cleaning liquid in an amount corresponding to the type of the recording medium 4 is supplied into the cleaning liquid baths 14, 15 respectively, and the ink concentrations in the respective cleaning liquid baths are controlled to respective predetermined values, while cleaning liquid in an amount corresponding to the amount of the cleaning liquid supplied from the supply liquid bath 16 to the downstream side cleaning liquid bath 15 is drained from the upstream side cleaning liquid bath 14 as liquid waste.

As described above, according to the present embodiment, liquid waste having become unusable as cleaning liquid in the downstream side cleaning liquid bath 15 is transferred to the upstream side cleaning liquid bath 14 by the transfer pump 22 and used as cleaning liquid in the upstream side cleaning liquid bath 14, while new cleaning liquid is supplied to the downstream side cleaning liquid bath 15 by the supply pump 21. Thus, it is possible to clean the conveying belt 7 efficiently and well enough, obtain satisfactory images, and reduce the cost of treating liquid waste.

Further, since the single motor 26 drives both the supply pump 21 and the transfer pump 22, miniaturization of the apparatus and reduction in cost can be achieved.

What is claimed is:

1. An image recording apparatus for recording an image on a recording medium, comprising:

a conveying belt for supporting and conveying the recording medium;

a recording head for recording the image by jetting ink onto the recording medium conveyed by the conveying belt;

a plurality of cleaning rollers for cleaning the conveying belt, the cleaning rollers being provided along a conveying direction of the conveying belt and in pressure-contact with the conveying belt; and a plurality of cleaning liquid baths, provided under the respective cleaning rollers, for respectively storing cleaning liquid to be used to remove dirt deposited on the respective cleaning rollers, and for dipping the respective cleaning rollers into the cleaning liquid, wherein, the apparatus uses liquid waste as cleaning liquid in a cleaning liquid bath on an upstream side of the conveying belt, the liquid waste having become unable to be used in a cleaning liquid bath on a downstream side of the conveying belt any longer as cleaning liquid.

2. The image recording apparatus of claim 1, comprising:

a liquid supply bath for storing the cleaning liquid and supplying the cleaning liquid at least to a cleaning liquid bath on a most downstream side;

a supply pump for supplying the cleaning liquid from the liquid supply bath to the cleaning liquid bath on the downstream side; and a transfer pump for transferring the cleaning liquid from the cleaning liquid bath on the downstream side to the cleaning liquid bath on the upstream side.

3. The image recording apparatus of claim 2, comprising a single motor for driving the supply pump and the transfer pump.

* * * * *